US005493748A

United States Patent [19]

Santo

[11] Patent Number: 5,493,748

[45] Date of Patent: Feb. 27, 1996

[54] TUBE CLEANING DEVICE

[76] Inventor: David Santo, 25 Evergreen Rd., Putnam Valley, N.Y. 10579-2220

[21] Appl. No.: 417,932

[22] Filed: Apr. 6, 1995

[51] Int. Cl.[6] ..... B08B 9/02; A46B 13/02

[52] U.S. Cl. ..... 15/104.04; 15/88; 15/104.05; 15/104.095; 15/106

[58] Field of Search ..... 15/104.03, 104.04, 15/104.05, 106, 88, 104.095, 23, 22.1, 4

[56] References Cited

U.S. PATENT DOCUMENTS 2,303,824 12/1942 Comins ..... 15/104.04
4,238,867 12/1980 Ruggero et al. ..... 15/104.095
5,307,534 5/1994 Miller ..... 15/104.095

FOREIGN PATENT DOCUMENTS 8402292 6/1984 WIPO ..... 15/104.04

*Primary Examiner*—Edward L. Roberts, Jr.
*Attorney, Agent, or Firm*—Abelman, Frayne & Schwab

[57] ABSTRACT

A device for cleaning either the outer or the inner surface of a pipe end includes a spindle having a tubular wire brush attached to one end thereof, and, an annular wire brush that is adjustable axially of said spindle between a retracted and an advanced position.

3 Claims, 1 Drawing Sheet

TUBE CLEANING DEVICE

FIELD OF THE INVENTION

This invention relates to a device for use by plumbers in the preparation of brass or copper pipe for soldering or brazing.

BACKGROUND OF THE INVENTION

It has been previously proposed, in Criswell et al. U.S. Pat. No. 4,862,549 issued Sep. 5, 1989, to provide a device for the preparation of pipe for soldering or brazing.

That device consists of an outer annular wire brush that is secured within a holder, and, a tubular wire brush that also is secured within the holder coaxially within the annular wire brush.

While this device initially performs admirably for its intended purpose, that device is subject to rapid wear and deterioration of the respective wire brushes, which both must be used simultaneously when preparing a pipe end in readiness for soldering or brazing.

Pipe soldering or brazing operations require either the removal of oxides from the exterior of the pipe end, or, the removal of oxides from the interior of the pipe end, there being no requirement to remove oxides from both the exterior and the interior of the pipe end at the same time. A dual cleaning operation, therefore, imposes unnecessary wear on the wire brush that is being employed for cleaning that surface of the pipe end that is not to be soldered or brazed, and, additionally involves wasted energy and unnecessary wear on the power tool employed for rotating the device.

This deficiency is recognized by Miller in U.S. Pat. 5,307,534 issued May 3, 1994.

Miller proposes a hand-held power tool having a driven shaft extending there through, and which terminates at respective ends of the power tool in collets to be employed for holding and driving either an annular wire brush to be employed for cleaning the exterior of a pipe end, or, a tubular wire brush to be used for cleaning the interior of a pipe end.

While Miller overcomes the disadvantage in Criswell of imposing unnecessary wear on the wire brushes, which can be employed singly instead of in tandem, Miller requires a specialized hand tool, which possibly is not readily available at the work site. In contrast, a single ended electrical drill commonly is available at the work site, or readily can be obtained by a workman.

The purchase of the Miller dual ended specialized power tool, represents a duplication of expense in the event that an electrical drill already is available to the workmen.

SUMMARY OF THE INVENTION

According to the present invention, there is provided a device that can be employed selectively for either cleaning oxides from the outer surface of a pipe end, or, can be employed for cleaning oxides from the inner surface of a pipe end, a simple change-over mechanism being provided whereby either one of the wire brushes can be employed selectively.

The advantage of this invention is that an expensive specialized power tool as taught by Miller is rendered unnecessary, while at the same time the rapid deterioration of the device taught by Criswell is significantly reduced, and further, either one of the wire brushes can be replaced when needed, without requiring simultaneous replacement of both of the brushes.

A preferred embodiment of the present invention employs a spindle that is appropriately sized for it to be received in the collet of a conventional power drill, the spindle carrying a tubular wire brush at its end remote from the collet.

Preferably the tubular wire brush is attached to the spindle by a screw mechanism, this permitting easy replacement of the tubular brush without discarding the spindle.

Coaxially mounted on the spindle is an annular wire brush that can be moved axially of the spindle between a retracted position in which the annular wire brush is positioned behind the tubular wire brush, and, an advanced position in which the tubular wire brush is protected within a carrier for the annular wire brush, and, the annular wire brush extends forwardly of the tubular wire brush.

A holder for the annular wire brush is releasably clamped to the spindle, any convenient means being provided for that purpose, for example, a lock nut which cooperates with an annular slotted ferrule, the lock nut preferably being one that can be hand adjusted by a workman.

In use of the device, it merely is necessary for the workman to loosen the lock nut, and then move the annular wire brush appropriately to a retracted or an extended position, in this way readying either the inner tubular wire brush for use in cleaning the inner surface of a pipe end, or, readying the outer annular wire brush for cleaning the exterior surface of the pipe end.

DESCRIPTION OF THE DRAWINGS

The invention will now be described in reference to the accompanying drawings, which illustrate a preferred embodiment of the invention, and, in which.

DESCRIPTION OF THE PREFERRED EMBODIMENT

Figure 1:
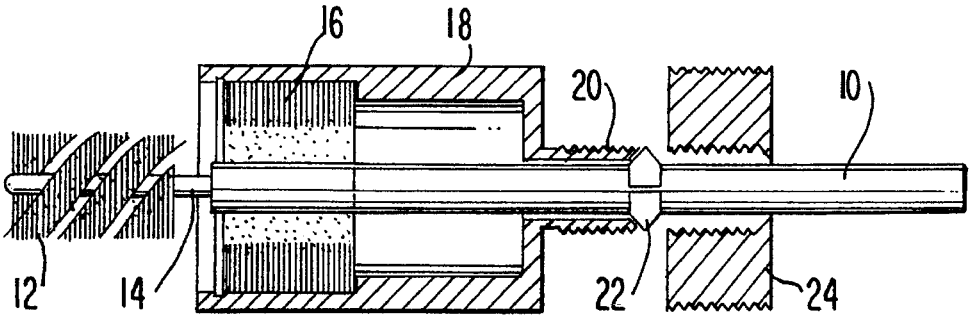
FIG. 1 is a longitudinal cross-section through the device showing the outer annular wire brush in a retracted position; and, FIG. 2 is a longitudinal section through the device showing the annular wire brush in an advanced position and in readiness for cleaning the exterior surface of a pipe end.

Referring now to the drawings, the device of the present invention for use in cleaning the end of a pipe, comprises an axially straight spindle that is sized for it to be received at one of its ends in the collet of a conventional power drill, for example, a quarter inch drill.

At its opposite end the spindle supports a tubular wire brush 12, which conveniently is removably attached to the spindle 10 by a threaded shank portion 14, thus making the wire brush 12 replaceable when worn Supported concentrically on the spindle 10 is an annular wire brush 16, which is supported within a cylindrical holder 18, the holder 18 terminating in a threaded tubular sleeve 20.

An axially slotted ferrule is positioned on the spindle 10 and is slidable axially thereof, the ferrule 22 being held in abutment with the free end of the threaded tubular sleeve 20 by means of a lock nut 24, which preferably is a manually operable lock nut provided on its outer periphery with knurling, enabling a workman readily to rotate the lock nut either into a locking position or a release position, the lock nut 24 being threadably received on the outer surface of the threaded tubular sleeve 20.

FIG. 1 illustrates the device prior to locking down of the lock nut 24, and in which the annular wire brush 16 has been retracted for it to be positioned behind the tubular wire brush 12.

When the annular wire brush is locked in position by locking down the lock nut 24, the device can then be used for the cleaning of the interior surface of a pipe end.

Figure 2:
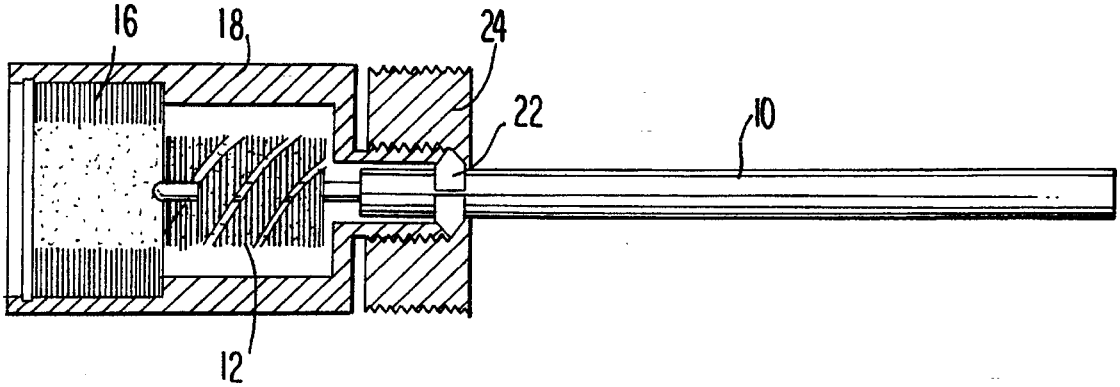

By simple release of the lock nut 24, the cylindrical holder 18 can be then be advanced axially along the spindle 10, to bring the annular wire brush into the position shown in FIG. 2, in which it is positioned in advance of the tubular wire brush 12, and, subsequent to locking down of the lock nut 24, is then readied for cleaning the exterior surface of a pipe end.

As will be appreciated, various other well-known structures can be employed for locking the cylindrical holder 18 in its selected axial position relative to the spindle 10, for example, the tubular sleeve 20 can be formed as a collet which is moved into clamping engagement with the spindle 10 by the lock nut 24. Alternatively, a locking pin can be employed which is passed through transverse bores extending through the spindle 10. Alternatively, spindle 10 can be of non-circular outline, for example, square or hexagonal, the tubular sleeve being correspondingly formed for it to be slidable on the non-circular spindle. In this instance, conveniently a spring latch can be employed for holding the cylindrical holder 18 in its selected position of axial adjustment relative to the spindle 10.

I claim:

1. A device for use in the preparation of a pipe end, comprising:

a spindle;

a tubular wire brush carried by said spindle at one end of said spindle;

a cylindrical holder mounted on said spindle for adjustment of said cylindrical holder axially of said spindle;

means for locking said cylindrical holder to said spindle in a selected position of adjustment of said holder relative to said spindle; and, an annular wire brush carried by said cylindrical holder; said cylindrical holder being adjustable relative to said spindle between a first position in which said tubular wire brush extends in advance of said annular wire brush, and a second position, in which said annular wire brush extends in advance of said tubular wire brush, and, said tubular wire brush is contained within said cylindrical holder.

2. The device of claim 1, in which said locking means includes an axially slotted ferrule slidably mounted on said spindle, and a lock nut threadably received on a threaded tubular extension of said cylindrical holder, said lock nut being operative to force said axially slotted ferrule into clamping engagement with said spindle.

3. The device of claim 1, in which said tubular wire brush is threadably secured to one end of said spindle.

* * * * *